United States Patent [19]

Baker

[11] Patent Number: 4,474,033

[45] Date of Patent: Oct. 2, 1984

[54] PASSIVE TRANSPORTABLE COOLING UNIT FOR STORING VIALS OF ALLERGENIC EXTRACTS OR THE LIKE

[76] Inventor: John F. Baker, 1018 Oakland Ave., Piedmont, Calif. 94611

[21] Appl. No.: 501,123

[22] Filed: Jun. 6, 1983

[51] Int. Cl.[3] ..... F25D 3/08

[52] U.S. Cl. ..... 62/457

[58] Field of Search ..... 62/457, 371, 372, 529, 62/530

[56] References Cited

U.S. PATENT DOCUMENTS

| | | | |
|---|---|---|---|
| 1,095,023 | 4/1914 | Parker | 62/457 X |
| 1,108,017 | 8/1914 | Steel | 62/457 X |
| 1,976,353 | 10/1934 | McIntosh et al. | 62/457 |
| 3,802,220 | 4/1974 | Pompo | 62/457 X |
| 3,974,658 | 8/1976 | Starrett | 62/457 X |
| 4,292,817 | 10/1981 | Loucks | 62/457 |

*Primary Examiner*—Lloyd L. King

*Attorney, Agent, or Firm*—Bruce & McCoy

[57] ABSTRACT

A passive transportable cooling unit for storing vials of allergenic extracts or the like has a vial tray and supporting gel plate filled with a freezable liquid gel, and an insulating carrier having an inner compartment which snugly holds the gel plate and vial tray. The insulated carrier has handle recesses for easy removal of the gel plate and vial tray, and the carrier is expandable for uses other than vial tray storage by means of an extension collar insertable between the carrier box and carrier lid.

11 Claims, 9 Drawing Figures

PASSIVE TRANSPORTABLE COOLING UNIT FOR STORING VIALS OF ALLERGENIC EXTRACTS OR THE LIKE

BACKGROUND OF THE INVENTION

The present invention relates to storing and transporting substances used in clinical medicine that require refrigeration. The invention particularly relates to the handling of trays of allergenic extracts, or like clinical liquids, which are normally stored and refrigerated in small glass vials of various standard sizes.

Allergenic extracts, which are used to test for patient allergies, are stored in small glass vials that may be handled by numerous persons and that may have to be sent through the mail or carried between a physicians' office, or even a patient's home, and a clinical laboratory for analysis. The liquid extract needs to be kept refrigerated and heretofore refrigerated storage consisted of placing vials in a vial tray in a refrigerator and only removing the vials for a short period of time for use or for transporting the vials unrefrigerated over short distances.

The present invention seeks to overcome the limitations and severe inconvenience imposed by conventional means of handling allergenic extracts, and to permit extracts to be transported over greater distances and to be easily handled in a clinical lab without the need to continually replace the vials in a lab refrigerator. The present invention specifically provides a passive transportable cooling unit wherein one or more vial trays can be easily stored within arms reach and in which small to large numbers of vials can be easily transported over large distances, such as between a doctor's office and a remote clinical lab.

SUMMARY OF THE INVENTION

The invention specifically provides for a passive transportable cooling unit having a hollow gel plate together with at least one vial tray having a plurality of vial holding cups formed in the tray. The hollow gel plate has an inlet for introducing liquid gel refrigerant into the plate such that the gel plate can be frozen to provide a passive cold source which serves as the vial tray support. An outer insulated carrier having an insulated box and lid is further provided and is of a size to accessibly carry the gel plate at the bottom of the carrier box with the vial tray atop the gel plate. The vial tray can be stored in the carrier and the entire carrier transported while the gel plate keeps the vials at a desired refrigerated temperature. In a preferred embodiment of the invention, hand recesses are provided in the sidewalls of the carrier to permit easy access for removing and inserting the gel plate and vial tray into the carrier. A collar extension can also be provided with the carrier to expand its storage capabilities by raising the height of the carrier box.

It is therefore a primary object of the present invention to provide a compact passive cooling unit which can hold a tray of allergenic extract vials in a refrigerated environment. It is also an object of the invention to provide a cooling unit in which a number of refrigerated vials can be transported long distances without the need to repackage the vials in a separate shipping container. Other objects of the inventions also include providing a cooling unit in which a vial tray can easily be removed and which is expandable for other uses. It is intended that the cooling unit which satisfies the above objectives be passive and not require a power source for refrigeration.

DETAILED DESCRIPTION OF THE PREFERRED EMBODIMENT

Figure 1:
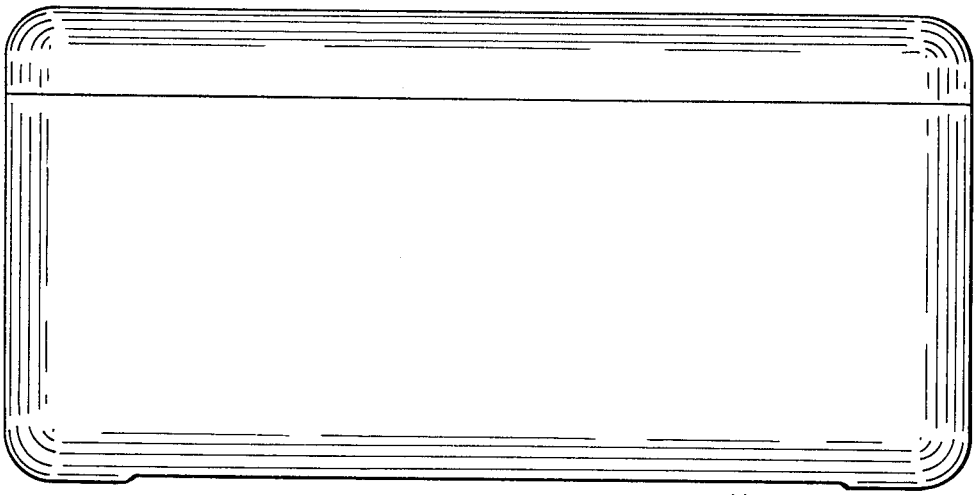
FIG. 1 is a side elevation view of the insulated carrier of the present invention.

Referring now to the drawings, a transportable cooling unit, generally denoted by the numeral 11, has an outer insulating carrier 13 comprised of an insulated carrier box 15 and a removable insulated carrier lid 17. The carrier 13 can be fabricated of styrofoam or other insulating material, and preferably would be provided with a durable hard shell coating. The carrier can also be manufactured economically by vacuum forming two hard plastic inner and outer shells and filling the space between the two shells with an expendable polyurethane foam. The advantage of this latter construction is that the polyurethane will provide greater insulation for a given wall thickness. For suitable insulation the carrier manufactured of expandable polyurethane foam will have wall and lid thicknesses of approximately one inch and, for weight, a bottom thickness of approximately two inches.

Figure 3:
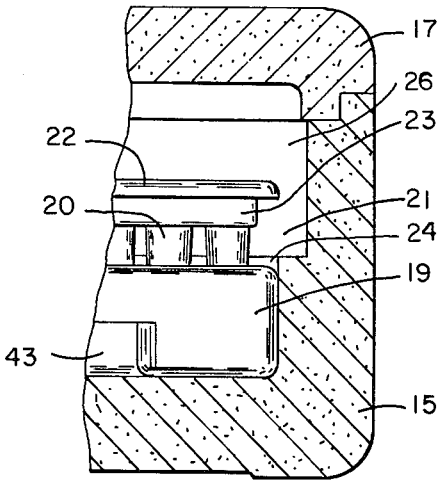
FIG. 3 is a partial cross-sectional view of the insulated carrier shown in FIG. 1, with a gel plate and vial tray placed in the carrier.

Referring to FIG. 3, it is seen that a gel plate 19 fits into the bottom of the inner compartment 21 of the carrier box 15, and that a flat vial tray 23 is provided which sets on top of the gel plate inside the inner insulated compartment. The lower portion 24 of the carrier box compartment is sized such that the gel plate fits snugly within this portion, while the upper portion 26 of the compartment, beginning at the top of the gel plate, is slightly larger to more loosely accommodate the vial tray. The height of the tray should be sufficient to accommodate standard sized vials standing in the tray 23, and no higher. It is desirable to have the inner compartment volume as small as possible to increase cooling efficiency and facilitate transportation.

Figure 5:
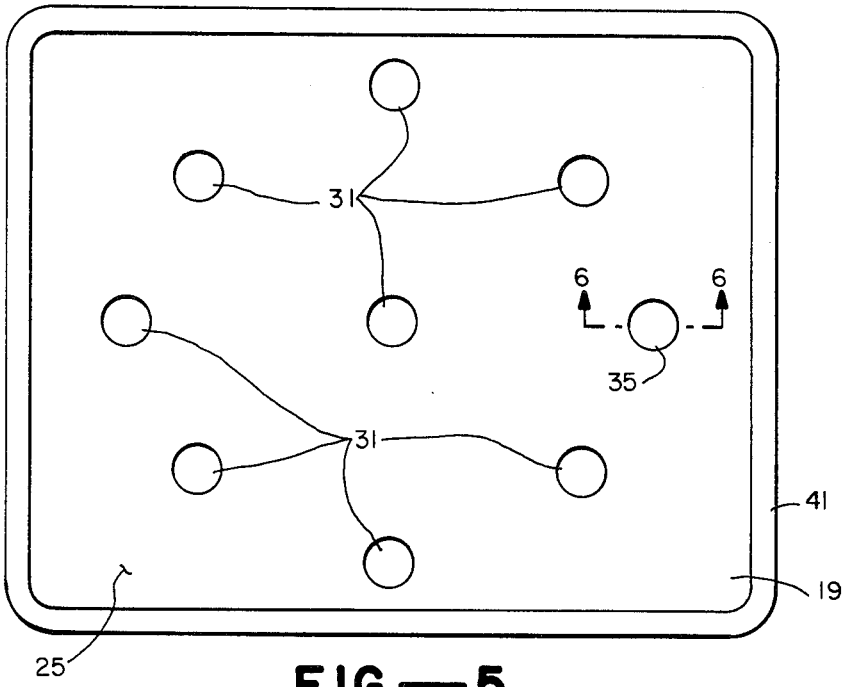
FIG. 5 is a top plan view of the gel plate used in the cooling unit of the invention.
Figure 6:
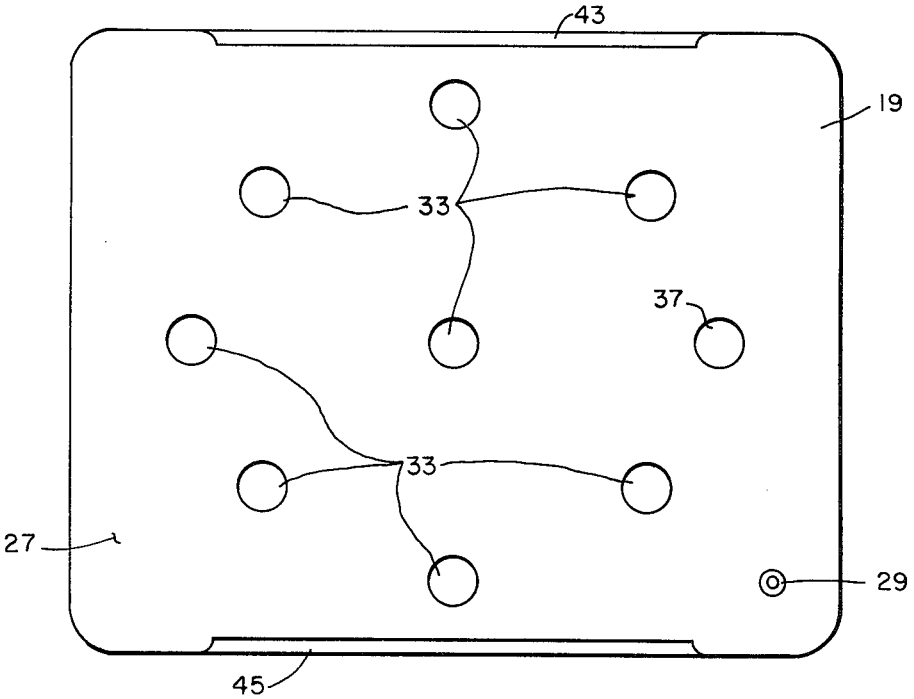
Fig. 6 is a bottom plan view of the gel plate shown in FIG. 5.
Figure 7:
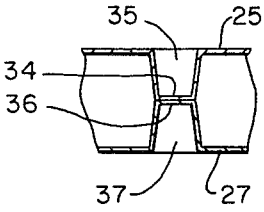
FIG. 7 is a partial cross-sectional view of the gel plate shown in FIG. 5 taken along section lines A—A, showing mechanical attachment between the top and bottom surfaces of the gel plate.

The construction of the gel plate 19 is illustrated in FIGS. 5 through 7, which show a flat rectangular hollow shell, preferably of a rigid plastic, having opposed flat, substantially parallel surfaces 25, 27. The hollow plastic shell is filled at inlet 29 with a commercially available liquid gel, and the entire gel plate frozen. To prevent the frozen gel from pushing the top and bottom surfaces 25, 27 apart thereby causing a bowing in these surfaces, both top and bottom surfaces of the plate are mechanically interconnected by a plurality of cup shaped depressions 31, 33 distributed over the top and bottom surfaces of the plate in opposition to each other. Each pair of depressions, such as depression 35 in the top surface 25 and the opposed depression 37 in the plate's bottom surface, is of sufficient depth to permit the bottoms 34, 36 of the depressions to meet at the center of the plate's hollow interior. The depression's bottom surfaces 34, 36 can be sealed, such as by heat sealing, to form a rigid mechanical tie.

As shown in FIG. 5, a slightly raised rim 41 is formed around the gel plates' top perimeter for containing the vial tray on the plate. Also, slight side wall recesses 43, 45 are preferably provided on the gel plate's opposing side walls. These features will facilitate handling of the gel plate and vial tray by keeping the vial tray centered on the gel plate and providing gripping surfaces for lifting the gel plate. The handling of the gel plate and vial tray are further facilitated by providing handle recesses 47, 49 (see FIG. 4) in opposite sidewalls of the insulated carrier box 13. This permits the user to easily reach down into the carrier to lift, from both sides, either the vial tray alone or the vial tray and gel plate together. If the carrier is fabricated from styrofoam, or other soft insulating material, the handle areas can be lined with a hard plastic liner 51, 53 to cover the side and bottom of the recess. The liner will prevent breakdown of the carrier walls in this area due to repeated insertion of the technician's hand.

Figure 4:
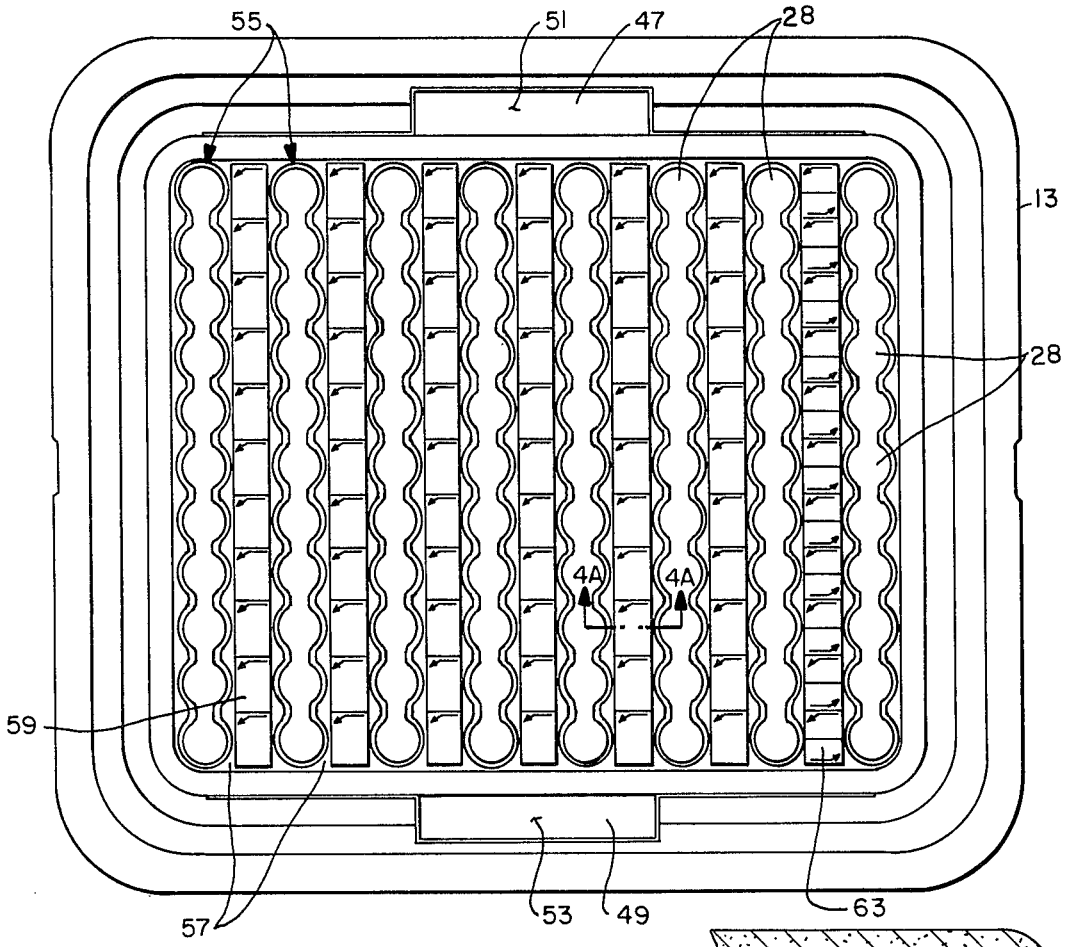
FIG. 4 is a top plan view of the cooling unit of the invention showing a vial tray in the insulated carrier.

The vial tray 23 is a thin plastic vacuum formed tray with a plurality of vial holding cups 20 having a diameter suitable for holding standard sized vials. While the vial holding cups of the vial tray shown in FIG. 4 are uniformly sized for one size of vial, it is understood that different vial trays can be provided with different sized vial holders for different sized vials. It is noted that a raised lip 22 extends around the perimeter of the vial tray to provide a gripping edge to the tray and to further provide structural rigidity. It has been found that, in the vacuum forming process, the presence of this raised lip will cause thinning of the vial cup walls for the cups 28 around the tray perimeter. It has been found that this problem can be alleviated by providing smaller vial cups at the tray perimeter thereby making more plastic available for the perimeter lip structure.

Figure 4A:
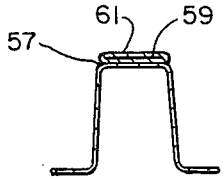
FIG. 4A is a view of the transparent sheath.
Figure 8:
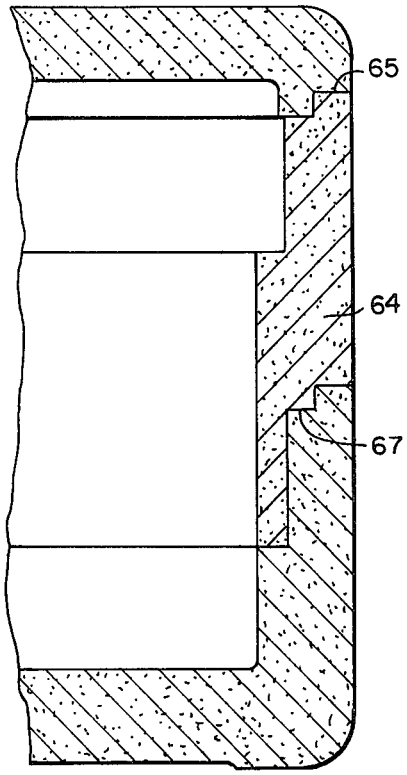
FIG. 8 is a partial cross-sectional view of the insulated carrier shown in FIG. 1, with the addition of an extension collar for expanding the height of the insulated carrier.

FIG. 4 shows a single unitary vial tray conforming in shape to the lower portion 24 of the carrier box compartment 21. The vial cups are arranged in rows 55 separated by raised shoulder surfaces 57 of sufficient width to permit labeling strips 59 to be adhesively fixed between vial rows. As shown in FIG. 4*a*, the transparent sheath 61 is preferably adhesively attached to each shoulder surface 57 such that labeling strips 59 can be removably inserted and exchanged as desired. Because in the FIG. 4 embodiment the number of vial holder rows exceeds the number of labeling strips by one, the right end labeling strip 63 is shown as labeling both adjacent vial holder rows.

Figure 2:
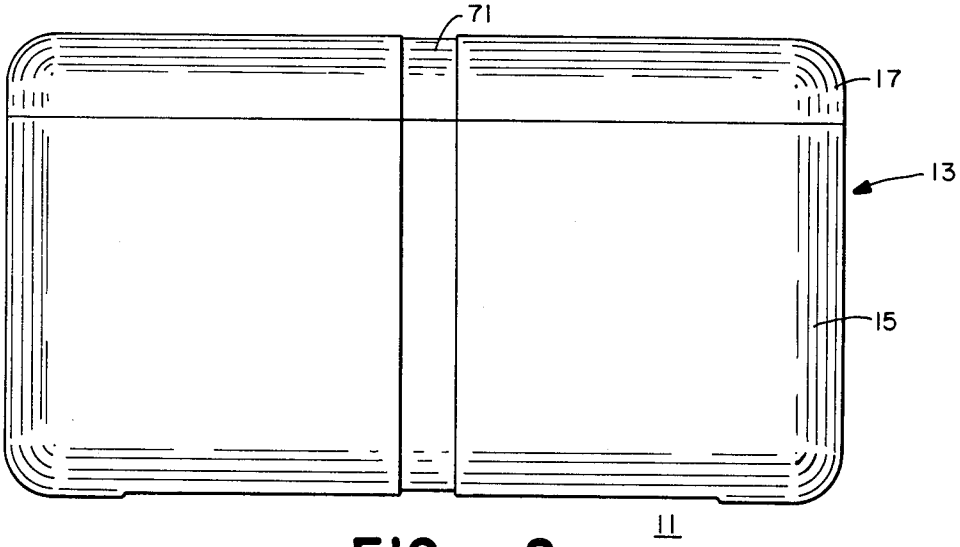
FIG. 2 is an end elevation view of the insulated carrier shown in FIG. 1.

It is seen that the gel plate of the invention, once filled with liquid gel and frozen, will serve as a supporting plate for the vial tray as well as the refrigerant for the cooling unit. The vial tray can be conveniently stored on the plate either in the cooling unit's carrier or separate from this carrier, and the plate can be conveniently used to transfer the vial tray from the carrier to a work station or to another refrigerating unit. The handling ease is maximized by the above-described carrier design which is both portable and versatile. In a preferred aspect of the invention, a carrying strap recess 71 also encircles the body of the carrier, so that a carrier strap (not shown) can simply be wrapped around the carrier to carry the entire cooling unit. It is also contemplated that an extension collar 64, having an interlocking top rim 65 and bottom rim 67 conforming in the shape, respectively, to the rim of the carrier lid 17 and the carrier box 15, will be provided to extend the height of the box where additional height is required. For example, a carrier such as shown in FIGS. 1 through 3, having a gel plate 19 as a refrigerant, can be extended in height by collar 64 to refrigerate larger articles other than the relatively flat vial tray shown in FIG. 4.

While the vial tray shown in FIG. 4 is a single unitary tray, it is understood that the present invention contemplates the use of two or more smaller vial trays, perhaps with different sized vial holding cups, placed on a single gel plate 19. For example, the vial tray shown in FIG. 4 could easily be divided into two side by side vial trays substantially half the size of the one shown.

Also, although the gel plate is described as being filled with a liquid gel, it shall be understood that the plate can be filled with any freezable liquid, such as water, and that the invention is not limited to use with a liquid gel.

Therefore, it is seen that the present invention provides a portable cooling unit for the storage and transporting of vials of allergenic extracts or other similar liquids. The refrigerant is provided in the form of a relatively flat gel plate insertable into an insulating carrier as a supporting surface for one or more vial trays. It is seen that the vial tray and vials can easily be removed from the top of the supporting gel plate and from the insulating carrier for use. Or the gel plate can be removed from the carrier with the vial tray. The gel plate and vial tray can then conveniently be returned to the carrier for storage or for transportation, as required.

Although the invention has been described in considerable detail in the above specification, it shall be understood that the invention is not to be limited to such detail, except as is necessitated by the appendent claims.

What I claim is:

1. A passive transportable cooling unit for storing vials of allergenic extracts or the like comprising at least one vial tray having a plurality of vial holding cups formed therein, a separate, rigid, hollow gel plate for supporting said vial tray on the top thereof, said gel plate having inlet means for introducing a liquid gel or other freezable liquid into said gel plate, and an outer insulating carrier having an insulating box and insulating lid, the box of said carrier being adapted to accessibly carry the gel plate at the bottom thereof and to accessibly carry the vial tray atop said gel plate whereby vials can be stored and transported in said cooling unit and easily removed from said cooling unit, with or without the supporting and cooling gel plate.

2. The cooling unit of claim 1 wherein said gel plate has parallel top and bottom surfaces mechanically interconnected to prevent outward bowing of said top and bottom surfaces due to expansion of gel in said gel plate.

3. The cooling unit of claim 2 wherein said mechanical interconnection between gel plate surfaces includes a plurality of distributed rigid mechanical ties between said surfaces.

4. The cooling unit of claim 3 wherein said mechanical ties are formed by opposing depressions in the top and bottom surfaces of said gel plate, the bottoms of which are sealed together.

5. The cooling unit of claim 1 wherein the vial holding cups of said vial holding tray are arranged in rows with a raised shoulder surface between rows for labeling of vials in said vial holding cups.

6. The cooling unit of claim 5 wherein a transparent plastic sheath is adhesively attached to the raised shoulder between vial cup rows in which a vial index strip can be removably inserted for identifying vials.

7. The cooling unit of claim 5 wherein said vial tray is fabricated of a vacuum formed plastic sheet and said vial holding cups extend to the perimeter of said vial tray, and wherein a raised perimeter rim is formed around the vial tray perimeter and the perimeter vial holding cups are sized smaller than interior vial holding cups whereby smaller vials are stored in perimeter cups and whereby excess plastic is available in the vacuum forming process to form said rim without weakening the walls of the perimeter cups.

8. The cooling unit of claim 1 wherein hand recesses are formed in the sides of the carrier box.

9. The cooling unit of claim 1 wherein said carrier box has an inner compartment with a lower portion sized such that the gel plate fits snugly therein, and a slightly upper portion for said vial tray.

10. A passive transportable cooling unit for storing vials of allergenic extracts or the like comprising at least one vial tray having a plurality of vial holding cups formed therein, said vial tray being fabricated of a vacuum formed plastic sheet and said vial holding cups extending to the perimeter of said vial tray, and said vial tray further having a raised perimeter rim, and the perimeter vial holding cups being sized smaller than interior vial holding cups whereby smaller vials are stored in perimeter cups and whereby excess plastic is available in the vacuum forming process to form said rim without weakening walls of the perimeter cups, a hollow gel plate for supporting said vial tray and having inlet means for introducing a liquid gel or other freezable liquid into said gel plate, said gel plate having a plurality of mechanical ties formed by opposing depressions in the top and bottom surfaces of said gel plate, the bottoms of which are sealed together, an outer insulating carrier having an insulating box and insulating lid, said box having an inner compartment with a lower portion sized such that the gel plate fits snugly therein, and a slightly larger upper portion for said vial tray, and hand recesses being formed in the sides of said carrier box to permit easy access to said vial tray and supporting gel plate whereby vials can be stored and transported in said cooling unit and easily removed from said cooling unit, with or without the supporting cooling gel plate.

11. The cooling unit of claim 10 wherein the volume of the inner compartment of said insulating carrier is just sufficient to permit standard sized vials to stand in said vial tray on said gel plate when the insulating lid is placed on the insulating box of said carrier.

* * * * *